US005660530A

United States Patent [19]

Rafei

[11] Patent Number: 5,660,530

[45] Date of Patent: Aug. 26, 1997

[54] PUMP SYSTEM FOR BIASING SEALS OF A CENTRIFUGAL PUMP

[76] Inventor: Iraj Rafei, 5706 SW. Hamilton St., Portland, Oreg. 97201

[21] Appl. No.: 357,596

[22] Filed: Dec. 15, 1994

[51] Int. Cl.[6] ..... F04F 1/06

[52] U.S. Cl. ..... 417/125; 417/122; 417/123; 417/423.11; 277/3; 137/207.5; 91/4 R; 415/175

[58] Field of Search ..... 417/122, 123, 417/125, 138, 423.11; 277/3; 137/207.5, 113, 563; 91/4 R, 4 A; 60/415; 415/175

[56] References Cited

U.S. PATENT DOCUMENTS

| | | | |
|---|---|---|---|
| 3,005,417 | 10/1961 | Swaney | 417/125 |
| 3,100,965 | 8/1963 | Blackburn | 91/4 R |
| 3,452,839 | 7/1969 | Swearingen | 277/3 |
| 3,722,365 | 3/1973 | Olsson | 91/4 A |
| 4,086,765 | 5/1978 | Gillilan | 417/125 |
| 4,206,928 | 6/1980 | Asano | 277/3 |
| 5,165,699 | 11/1992 | Shrontz et al. | 277/3 |
| 5,242,272 | 9/1993 | Ven et al. | 91/4 R |

*Primary Examiner*—Timothy Thorpe
*Assistant Examiner*—Roland G. McAndrews, Jr.
*Attorney, Agent, or Firm*—Robert L. Harrington

[57] ABSTRACT

Pumping under the present invention includes movement of material, in a first embodiment fluid and in a second embodiment a piston assembly, between first and second positions including detection of said material at each position. Control circuitry and supporting mechanical and fluid coupling responsive to material position toggles the pump into alternate modes of operation driving the material toward each point. The pump arrangement has fewer moving parts than traditional pumps and enjoys higher reliability for its simplified design.

11 Claims, 3 Drawing Sheets

PUMP SYSTEM FOR BIASING SEALS OF A CENTRIFUGAL PUMP

BACKGROUND OF THE INVENTION

The present invention relates generally to pumping devices and particularly to a pumping device having limited moving mechanical parts.

All pumps of whatever type are subject to mechanical wear. In the case of a recirculating pump, where the outlet fluid eventually returns to the inlet, a rotary gear pump has been generally used. Because it is a constant volume pump, it should be sized according to the expected fluid demand. A recirculating pump is especially vulnerable to any dirt or debris in the fluid. Further, a recirculating pump is not easily movable because of the required driving unit used in conjunction with a recirculating pump. The driving unit, mechanical coupling, and recirculating pump itself all combine to reduce reliability and increase maintenance costs. A recirculating pump is usually not expected to have a high delivery rate, but reliability is of the utmost importance. In particular, as used in oil drilling operations a recirculating pump must operate to maintain operation of the entire oil well. Once the recirculating pump fails, the entire oil well must be shut down for repair or replacement of the recirculating pump.

Air driven pumps have the liability of a mechanical shuttle arrangement built into the pump itself, and the shuttle arrangement is a typical cause for pump failure. The mechanical constraints of the shuttle valve often put a limit on pump configuration. Pump discharge pressure typically cannot be raised much without sacrificing output volume. Many air driven pumps also use a diaphragm along with the shuttle valve and this introduces an additional source of potential mechanical failure.

SUMMARY OF THE INVENTION

A pump under one embodiment of the present invention comprises an air source for coupling to air pressurized relative to ambient air pressure, a first chamber including an inlet and an outlet, and a second chamber including an inlet and an outlet. An air pressure conduit network couples, in a first state, the air source and the first chamber and couples, in a second state, the air source and the second chamber inlet. A transfer conduit network couples, in a first state, the first chamber outlet and the second chamber inlet. The transfer conduit couples, in a second state, the second chamber outlet and the first chamber inlet. A control drives into selected states each of the air pressure conduit network and the transfer conduit network to cause exchange of fluid between the first and second chambers.

A pump under the present invention provides suction of a fluid body and discharge of a fluid body obtained by suction, and includes at least one power cylinder having slidably and sealably disposed therein a piston defining a first and second chamber of the pumping cylinder. A pressurized air conduit network couples, in a first state, a source of pressurized air and the left chamber while concurrently opening for exhaust the right chamber. In a second state of air said conduit network, said network couples the source of pressurized air to the right chamber while concurrently opening the left chamber for exhaust. A pumping cylinder, including a piston slidably disposed therein and mechanically coupled to the pumping cylinder piston, defines a chamber of the pumping cylinder. A discharge port and a suction port fluidly coupled to the pumping cylinder chamber accomplish alternate suction of the fluid body and discharge of the fluid body obtained by suction.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENT

Figure 1:
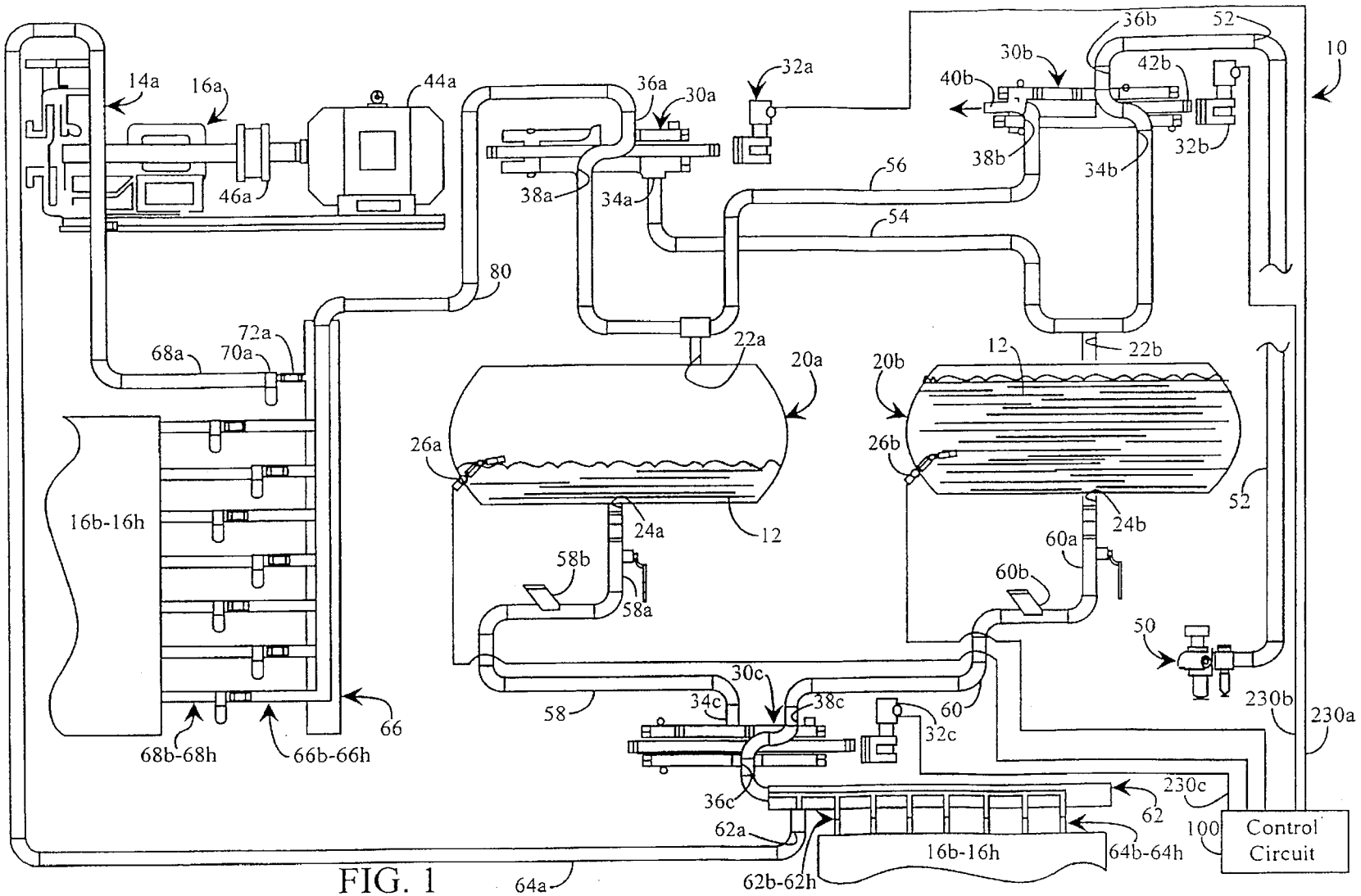
FIG. 1 illustrates a first embodiment of the present invention applied as a recirculating pump maintaining a sealing liquid against a double mechanical seal in a primary pumping system.

FIG. 1 illustrates a first embodiment of the present invention applied as a recirculating pump maintaining a sealing liquid, e.g., oil, pressurized against a double mechanical seal of a primary pumping system. For example, such primary pumping system might be as found in oil well drilling transfer pumps. Transfer pumps carry abrasive material and desirably include a sealing liquid maintained at controlled pressure against double acting seals to avoid excessive deterioration thereof. The first illustrated embodiment of the present invention finds application in an oil well drilling system maintaining sealing liquid at controlled pressure against a double mechanical seal of a centrifugal pump.

In FIG. 1, an air powered recirculator 10 maintains a sealing liquid 12 pressurized relative to a double mechanical seal 14 of a plurality of centrifugal pumps 16 (one such pump 16*a* being shown in FIG. 1). Recirculator 10, in the particular embodiment of in FIG. 1, accommodates eight such centrifugal pumps 16. Pump 16*a* and corresponding double mechanical seal 14*a* is shown in FIG. 1 and remaining centrifugal pumps 16*b*–16*h* are shown schematically and by block diagram in FIG. 1. While illustrated for service of eight such centrifugal pumps 16, it will be understood that recirculator 10 may be modified to support fewer than eight pumps 16, e.g., by plugging appropriate supply and drain manifolds, and to support more than eight pumps 16 by increasing the drain manifold inlets and the supply manifold outlets as will be apparent given the disclosure herein.

Recirculator 10 includes chambers or tanks 20*a* and 20*b*. Each tank 20 includes an inlet 22 at an upper portion thereof and a drain 24 at a lower portion thereof. Recirculator 10 further includes spool valves 30*a*, 30*b*, and 30*c* with a network of conduits coupling valves 30, tanks 20, and pumps 16 as described more fully hereafter. A first portion of the conduit network selectively and alternately applies air pressure to the inlets 22 while the remaining portion provides a fluid 12 transfer path between tanks 20 and including seals 14. Generally, when one of tanks 20 is draining, under air pressure applied to its inlet 22, the other tank 20 is refilling with sealing liquid 12 applied to its inlet 22 and originating from the draining tank 20.

As illustrated in FIG. 1, tank 20*b* is presently draining with air pressure applied at the inlet 22*b* and liquid 12 forced out drain 24*b*. Also in FIG. 1, tank 20*a* is presently filling with a source of recirculated sealing liquid 12 provided at inlet 22*a*. Sealing liquid 12, as transferred under pressure between tanks 20*a* and 20*b*, passes by mechanical seals 14 of centrifugal pumps 16, e.g., past seal 14*a* of pump 16*a*. Because sealing liquid 12, when present at each seal 14, is controllably pressurized, sealing liquid 12 performs the desired function sealing with respect to operation of pumps 16. Once past the mechanical seals 14, sealing liquid 12 returns to a "filling" one of tanks 20.

Each of tanks 20*a* and 20*b* further includes a level detection switch 26, illustrated individually as switches 26*a* and 26*b*, respectively. When the level of sealing liquid 12 in a given tank 20 passes below the corresponding level switch 26, the tank 20 is considered "empty" and the switch 26 changes state. When sealing liquid 12 in a given tank 20 rises above the corresponding level switch 26, level switch 26 changes state. The state of switches 26*a* and 26*b* represent a measure of volume of sealing liquid 12 in each of tanks 20*a* and 20*b*, respectively, relative to a reference "empty" volume. In the illustrated example of FIG. 1, each of level switches 26 are located near the corresponding drains 24, and therefore represent volume of sealing liquid 12 relative to an "empty" condition though not allowed to literally empty completely of fluid 12.

Each of spool valves 30*a*–30*c* are driven by a corresponding one of solenoids 32, individually designated 32*a*–32*c*, respectively. A control signal 230, individually 230*a*–230*c*, applied to each solenoid 32 dictates operation in a selected state. Each of spool valves 30 include fluid ports 34, 36, and 38, designated individually by subscript. For example, spool valve 30*a* includes ports 34*a*, 36*a*, and 38*a*.

In addition, spool valve 30*b* contains air exhaust ports 40*b* and 42*b*. Valves 30*a* and 30*c* are identical. Valve 30 operation is as follows: without power applied to the solenoid of valve 30*a*, port 36*a* is connected to port 34*a* and port 38*a* is blocked. With power applied to the solenoid of valve 30*a*, port 36*a* is connected to port 38*a* and port 34*a* is blocked. As shown in FIG. 1, power is presently applied to the solenoid 32*a* of valve 30*a*. Accordingly, port 36*a* is connected to port 38*a* and port 34*a* is blocked. Further, as presently illustrated in FIG. 1, power is not applied to the solenoid 32*c* of valve 30*c*. Accordingly, port 36*c* is connected to port 38*c* and port 34*c* is blocked.

Valve 30*b* does not have a blocked port at any time. Operation of valve 30*b* is as follows: with no power applied, port 36*b* connects to port 34*b* and port 38*b* connects to exhaust port 40*b*. With power applied, however, port 36*b* is connected to port 38*b* and port 34*b* connects to exhaust port 42*b*. In FIG. 1, valve 30*b* is shown presently with no power applied.

With power applied, each valve 30 operates in a powered state. With no power applied, each valve operates in an unpowered state. As shown in FIG. 1, valve 30*a* is in its powered state and valves 30*b* and 30*c* are in their unpowered state. When tank 20*b* eventually empties and tank 20*a* is filled, the control-signal to each spool valve 30*a*, 30*b*, and 30*c* changes, i.e., spool valve 30*a* enters its powered state and valves 30*b* and 30*c* go to their unpowered state.

Recirculator 10 receives pressurized air at its air regulator/filter 50. Conduit 52 couples air regulator/filter 50 to port 36*b* of spool valve 30*b*. Conduit 54 couples port 34*b* of spool valve 30*b*, inlet 22*b* of tank 20*b*, and port 34*a* of spool valve 30*a*. Conduit 56 couples port 38*b* of spool valve 30*b*, inlet 22*a* of tank 20*a*, and port 38*a* of spool valve 30*a*. Conduit 58, including an isolation valve 58*a* and strainer 58*b*, couples drain 24*a* of tank 20*a* and port 34*c* of spool valve 30*c*. Conduit 60, including an isolation valve 60*a* and strainer 60*b*, couples drain 24*b* of tank 20*b* and port 38*c* of spool valve 30*c*.

Port 36*c* of spool valve 30*c* couples directly to a common chamber of manifold 62. Manifold 62 distributes sealing liquid 12 as received from spool valve 30*c* among eight manifold 62 ports 62*a*–62*h*. Each of manifold 62 ports 62*a*–62*h* couple to a corresponding one of pumps 16*a*–16*h*. For example, conduit 64*a* couples port 62*a* to mechanical seal 14*a* of centrifugal pump 16*a*. Similar conduits 64*b*–64*h* couple manifold 62 ports 62*b*–62*h* to corresponding ones of pumps 16*b*–16*h* as illustrated schematically in FIG. 1.

Each of pumps 16 couple by one of conduits 68*a*–68*h* to inlet ports 66*a*–66*h* of a drain manifold 66. For example, conduit 68*a* couples seal 14*a* and drain manifold 66 inlet 66*a*. Similar conduits 68*b*–68*h* couple corresponding ones of seals 14*b*–14*h* with inlets 66*b*–66*h* of drain manifold 66. Each of conduits 68 terminate, i.e., just prior to a common chamber of manifold 66, with an oil filter 70 and line restriction 72. For example, conduit 68*a* terminates at filter 70*a* and line restriction 72*a*. Each oil filter 70 removes debris picked up in what is referred to as the "stuffing box", i.e., picked up at the seal 14 of pump 16. Restrictions 72 are small relative to the corresponding conduit 68. The degree of restriction provided by each of restrictions 72*a*–72*h* in conjunction with the regulated air pressure and sealing liquid 12 viscosity determines the sealing liquid 12 flow rate individually for each of centrifugal pumps 16*a*–16*h*, respectively. Conduit 80 couples the common chamber of manifold 66 to port 36*a* of spool valve 30*a*.

Figure 2:
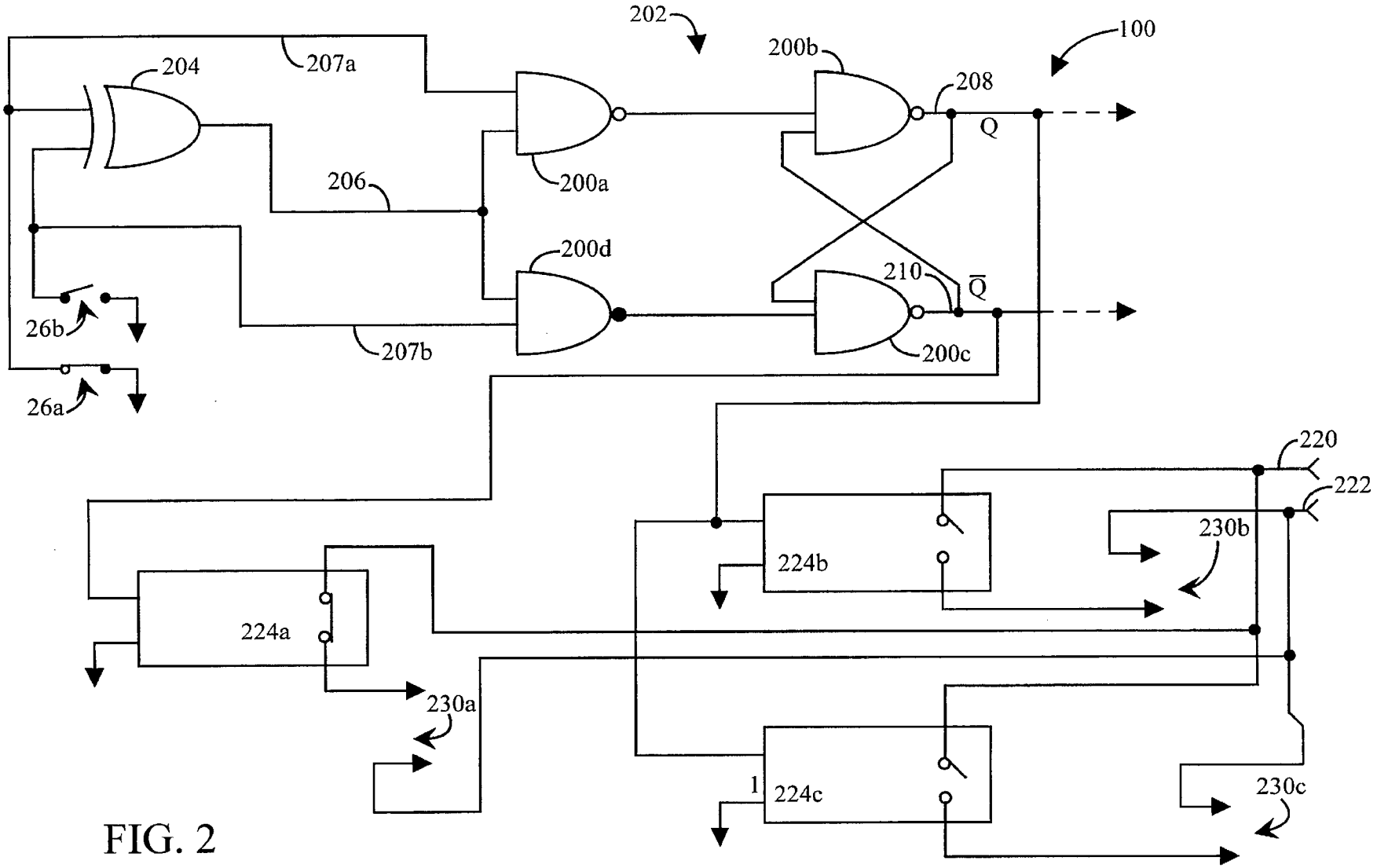
FIG. 2 illustrates a control circuit responsible for operation of the pump under the present invention.

FIG. 2 illustrates control circuit 100, responsible for detecting and comparing the condition of level switches 26*a* and 26*b*, and then appropriately driving solenoids 32*a*–32*c* to place spool valves 30*a*–30*c* into an appropriate state. In FIG. 2, control circuit 100 senses, by way of switches 26*a* and 26*b*, fluid 12 level in each of tanks 20*a* and 20*b*, respectively. NAND gates 200*a*–200*d* connect to form an RS latch 202. An exclusive OR gate 204 provides an enable signal 206 to latch 202. Switches 26*a* and 26*b* provide respective first and second inputs to exclusive OR gate 204. Further, switch 26*a* applies as an input 207*a* to gate 200*a* and switch 26*b* applies as an input 207*b* to gate 200*d*.

The output of exclusive OR gate 204 is high only when the state of switch 26*a* is different from that of switch 26*b*. Once the enable signal to latch 202 is present, latch 202 responds to the inputs 207 provided by switches 26*a* and 26*b*. Inputs 207 to latch 202, therefore, can only be recognized by latch 202 when either tank 20*a* or tank 20*b* is "empty" as indicated by the corresponding one of switches 26*a* and 26*b*. Tanks 20*a* and 20*b* are never "empty" concurrently. When tank 20*b* is empty, it is assumed that tank 20*a* is full. At all intermediate points, i.e., when both tanks 20*a* and 20*b* contain fluid, the exclusive OR gate 204 disables latch 202. Accordingly, the Q output 208 and NOT Q output 210 of latch 202 remain stable, i.e., in the same state that existed at the time the exclusive OR gate 204 last detected one of tanks 20*a* and 20*b* as being "empty."

As fluid 12 transfers from, for example, tank 20*b* to tank 20*a*, tank 20*b* eventually becomes "empty" and tank 20*a* eventually becomes "full." At the time that exclusive OR gate 204 detects an "empty" signal from switch 26*b*, exclusive OR gate 204 generates an enable signal for latch 202 causing the outputs 208 and 210 of latch 202 to reverse state.

Tank 20b then begins to fill. Once tank 20b fills and tank 20a empties, the cycle repeats.

An AC power source, including an AC line voltage 220 and neutral voltage 222, applies to a network of solid state relays 224, individually 224a–224c. In particular, a load A output 230a includes the neutral voltage 222 and a switched AC line voltage 220, i.e., switched via solid state relay 224a. Similarly, a load B output 230b includes neutral voltage 222 and a switched line voltage 220, i.e., switched via solid state relay 224b. Finally, output 230c includes neutral voltage 222 and to a switched line voltage 220, i.e., switched via solid state relay 224c. Latch 202 Q output 208 drives solid state relays 224b and 224c while latch 202 NOT Q output 210 drives solid state relay 224a. As may be appreciated, outputs 208 and 210 may also drive additional solid state relays 224 if needed. With control circuit 100 outputs 230a–230c coupled to corresponding ones of solenoids 32a–32c, as shown in FIG. 1, control circuit 100 responds to the level of fluid 12 in tanks 20a and 20b to appropriately drive valves 30a–30b and accomplish alternating transfer of fluid 12 between tanks 20a and 20b.

FIG. 1 illustrates initial conditions where tank 20b is "full" of sealing liquid 12 and tank 20a is "empty", i.e., below level switch 26a. Additional initial conditions also illustrated in FIG. 1 show spool valve 30a port 36a coupled to port 38a. Spool valve 30b couples its ports 36b and 34b and couples its port 38b to ambient air.

In operation of the embodiment illustrated in FIG. 1, tank 20b is initially filled with sealing liquid 12. Air pressure applied via spool valve 30b at inlet 22b of tank 20b forces sealing liquid 12 in tank 20b through its drain 24b and, via conduit 60 and spool valve 30c into manifold 62. Air pressure in conduit 54, i.e., as applied to inlet 22b of tank 20b, is blocked at port 34a of spool valve 30a. In such condition, sealing liquid 206 flows from tank 12 under regulated air pressure through isolation valve 60a, strainer 60b, spool valve 30c, manifold 62, conduits 64, mechanical seals 14 of pumps 16, through conduits 68, into manifold 66 and returns to tank 20a by way of spool valve 30a and inlet 22a. Because drain manifold 66 pressure is atmospheric, sealing liquid 12 simply flows to spool valve 30a and drains into empty tank 20a. As tank 20a fills with sealing liquid 12, air existing in tank 20a exhausts through conduit 56 to ports 38b and 40b of spool valve 30b.

Eventually, tank 20b drains sufficiently and state transition in switch 26b occurs. Control circuitry 100 detects this transition, samples the current state of switches 26a and 26b, manipulates spool valves 30 and toggles operation of recirculator 10 into a second state transferring sealing liquid 12 in tank 20a to tank 20b.

The recirculator 10 as illustrated in FIGS. 1 and 2 enjoys significant advantages relative to prior recirculator pumps. First, recirculator 10 is primarily air powered, with the only electric power required, being that needed to operate control circuit 100 and solenoids 32. A sufficient air supply is generally available wherever centrifugal pumps 16 are used, but not necessarily a convenient electrical energy supply. Furthermore, the cubic foot per minute demand of recirculator 10 is relatively low and pressure required is generally less than 100 pounds-per-square inch (PSI). Importantly, recirculator 10 has few mechanical moving parts. In fact, only the solenoid valves 32 and switches 26 mechanically change position. As a result, recirculator 10 has extremely low maintenance costs and high reliability. A single recirculator 10 provides constant sealing fluid 12 pressure across a number of pump 16 "stuffing boxes." As indicated herein above, the number of pumps 16 supported by a single recirculator 10 may vary by simple modification to recirculator 10. Flow rate may be adjusted individually over a relatively wide range with respect to each centrifugal pump 16. Sealing liquid 12 as applied to pump 16 stuffing boxes is both recirculated and filtered. As a result, the life of mechanical seals 14 is greatly extended. Furthermore, recirculating sealing liquid 12 avoids undesirable environmental discharge of fluid 12. As a result, recirculator 10 enhances environmental criteria at each centrifugal pump 16.

Figure 3:
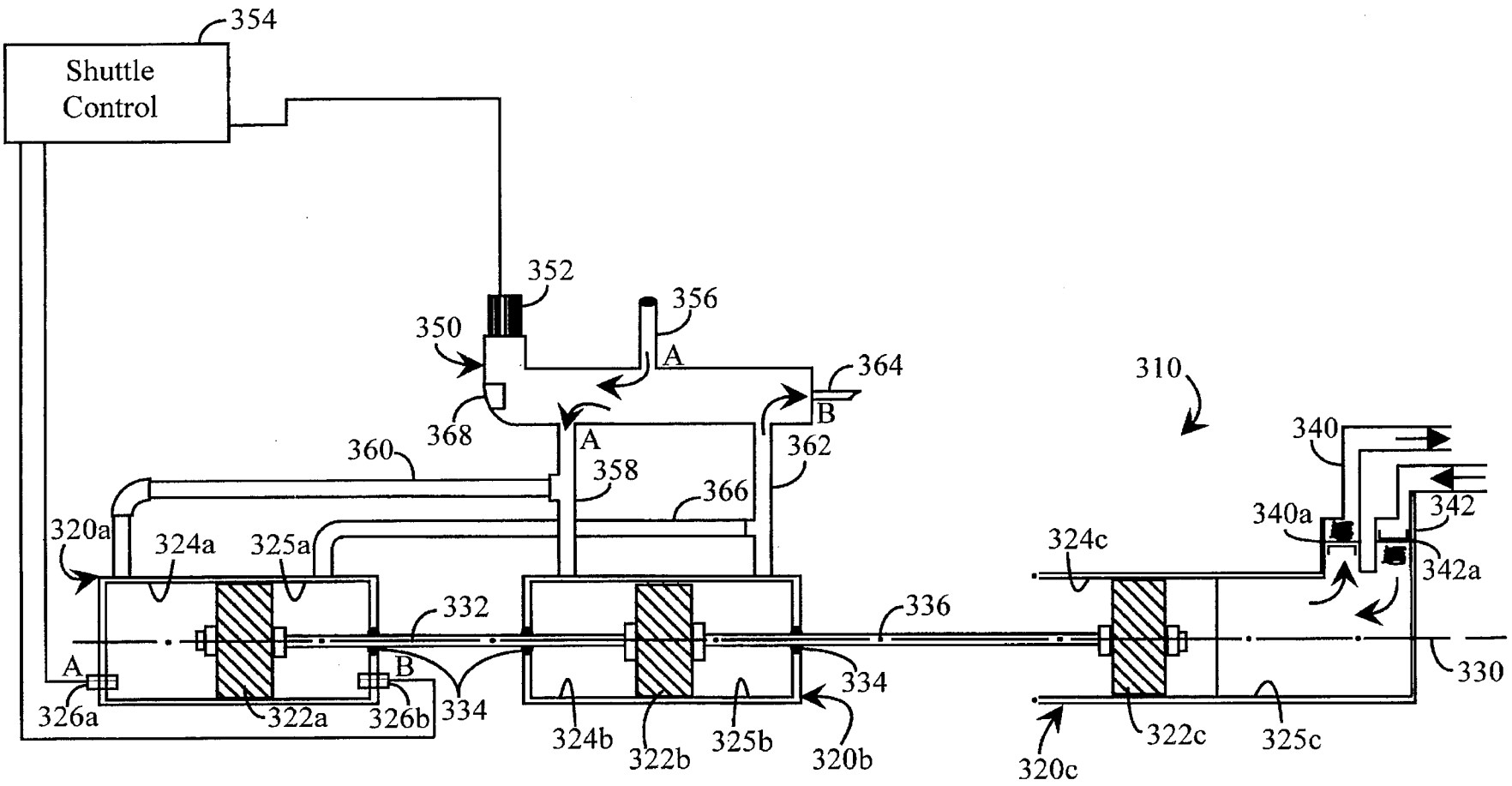
FIG. 3 illustrates a second embodiment of the present invention operating as a shuttle pump.

FIG. 3 illustrates a second embodiment of the present invention, a shuttle pump 310. Shuttle pump 310 includes cylinders 320, individually, 320a, 320b, and 320c. Pistons 322, individually pistons 322a, 322b, and 322c, reside slidably and sealably in each of the cylinders 320a, 320b, and 320c, respectively. Pistons 322a and 322b define within each of the corresponding cylinders 320a and 320b a left chamber 324 and a right chamber 325, with reference to the orientation of FIG. 3. For example, piston 322a defines a left chamber 324a and a right chamber 325b within cylinder 320a. Piston 322c defines a right chamber 325c within cylinder 320c.

Cylinders 320 lie coaxially and pistons 322 couple mechanically with fixed spacing therebetween along a central axis 330. In particular, rod 332 couples in fixed relation pistons 322a and 322b. Rod 332 passes in sliding, sealed relation relative to chambers 325a and 324b at sealed rod support apertures 334 as provided in cylinders 320a and 320b. Similarly, rod 336 couples in fixed relation pistons 322b and 322c and passes in sliding, sealed relation to chamber 325b at support aperture 334 as provided in cylinder 320b.

Cylinder 320a further includes proximity switches 326a and 326b detecting given leftward and rightward excursion, respectively, of piston 322a relative to cylinder 320a. Cylinder 320c includes at its right chamber 325c a discharge port 340 and a suction port 342. Intermediate of discharge port 340 and chamber 325c is a check valve 340a. Similarly, intermediate suction port 342 and chamber 325c is a check valve 342a.

A four-way open exhaust solenoid valve 350 includes a solenoid 352 driven between first and second states by means of shuttle control 354. In a first state, valve 350 couples its inlet port 356, receiving a source of pressurized air, with a first outlet 358. Outlet 358 couples by means of conduit 360 to the left chambers 324a and 324b of cylinders 320a and 320b, respectively.

In the first state of solenoid valve 350, a second port 362 couples to exhaust port 364 and exhaust port 368 is blocked. Conduit 366 couples second outlet 362 to the right chambers 325a and 325b of cylinders 320a and 320b, respectively. Thus, in the first state of solenoid valve 350, pressurized air appears in the left chambers 324a and 324b of cylinders 320a and 320b while cylinders 320a and 320b exhaust air from the right chambers 325a and 325b by way of exhaust outlet 364.

In the second state, valve 350 couples its inlet port 356 to port 362, thus pressurizing chambers 325a and 325b of cylinders 320a and 320b, respectively. In this second state, valve 350 allows escape of air through port 358 to the now open exhaust port 368 from the left chambers 324a and 324b of cylinders 320a and 320b, respectively. Exhaust port 364 is blocked.

Cylinders 320a and 320b are considered the "power" cylinders and cylinder 320c the "pumping" cylinder. When pressurized air is applied to the inlet port 356 of valve 350, given the device state illustrated in FIG. 3, the left chambers of the "power" cylinders are pressurized while the right chambers of the "power" cylinders are opened to the atmosphere. As the pistons 322*a* and 322*b* move to the right, eventually piston 322*a* engages proximity switch 326*b*. Shuttle control 354 responds by driving solenoid valve 350 into its opposite state. This introduces pressurized air into the right chambers 325*a* and 325*b* of the "power" cylinders 320*a* and 320*b* and allows the left chambers 324*a* and 324*b* of the "power" cylinders 320*a* and 320*b* to exhaust. The assembly of pistons 322 then moves leftward in the view of FIG. 3. Eventually, piston 322*a* engages proximity switch 326*a* and shuttle control 354 drives valve 350 into its opposite state and the cycle repeats. Pistons 322 thereby shuttle alternately leftward and rightward.

As pistons 322 move rightward, fluid present in right chamber 325*c* of cylinder 320*c* is forced out through check valve 340*a* to discharge port 340*a*. Suction check valve 342*a* is forced to a closed position. Similarly, as pistons 322 move leftward, chamber 325*c* of cylinder 320 fills with fluid as drawn in through the suction port 342. In this manner, fluid is alternately drawn into suction port 342 and discharged from discharge port 340.

In this second embodiment of the present invention, control 354 is substantially identical to control 100 described above for the first embodiment of the present invention. The second embodiment, however, requires only one relay following the Q output of the RS latch and one relay following the NOT Q output of the RS latch. As may be appreciated, the condition sensed in the second embodiment of the present invention is cylinder position, as opposed to fluid level in the first embodiment. In each embodiment, the control device is a mechanism detecting position of a material and causing shuttle of such material alternately between two points.

By stacking additional "power" cylinders, i.e., similar to cylinders 320 and 320*b* and coupled for coordinated movement with pistons 322*a* and 322*b*, magnification of the pumping and suction pressure is achieved. Also, when the "power" pistons have a greater diameter relative to the "pumping" piston, e.g., six and one-half inches versus five inches diameter, then the output pressure may be computed as $2(6\frac{1}{2}/5)^2$(input air pressure). Thus, assuming an input pressure of 120 PSI, the output pressure is 405 PSI. Thus, either or both piston stacking and relative diameter of power/pumping piston ratio can be changed to achieve a pressure or volume change.

Using the control 354 and air operated piston pump arrangement of the shuttle pump 310, the shuttle mechanism is external to the pump. Accordingly, piston and cylinder layout is simplified and made more flexible.

Shuttle pump 310 is powered primarily by pressurized air, requiring only sufficient electrical energy to operate shuttle control 354 and solenoid 352 of valve 350. The relatively few moving parts required in shuttle pump 310 support a substantially reduced cost of manufacture and maintenance cost.

It will be appreciated that the present invention is not restricted to the particular embodiment that has been described and illustrated, and that variations may be made therein without departing from the scope of the invention as found in the appended claims and equivalents thereof.

What is claimed is:

1. A recirculating pump system for biasing a seal of a centrifugal pump, said recirculating pump system comprising:

a body of biasing fluid;

a first chamber;

a second chamber;

a transfer conduit coupling said first and second chambers;

a body of biasing fluid within said first and second chambers; and a pumping and electronic control portion detecting levels of said body of biasing fluid within said at least two chambers and moving said body of biasing fluid between said at least two chambers, said conduit being fluidly coupled to said seal to bias said seal with said body of biasing liquid.

2. A recirculating pump according to claim 1 wherein said pumping and electronic control portion comprises:

an air source for coupling to air pressurized relative to ambient air pressure;

an inlet and an outlet for said first chamber;

an inlet and an outlet for said second chamber; and an air conduit coupling in a first state thereof said air source and said first chamber inlet and coupling in a second state thereof said air source and said second chamber inlet, said transfer conduit coupling in a first state thereof said first chamber outlet and said second chamber inlet and coupling in a second state thereof said second chamber outlet and said first chamber inlet.

3. A recirculating pump according to claim 2 wherein said pumping and electronic control portion further comprises:

sensors detecting said levels of said body of biasing fluid within said first and second chambers, said electronic control responsive to said sensors to drive said air conduit selectively into one of said first and second states thereof and to drive said transfer conduit selectively into one of said first and second states thereof.

4. A recirculating pump according to claim 3 wherein said sensors detect a first chamber near empty condition and in response said electronic control drives said air conduit into its second state and drives said transfer conduit into its second state.

5. A recirculating pump according to claim 3 wherein said sensors detect a second chamber near empty condition and in response said electronic control drives said air conduit into its first state and drives said transfer conduit into its first state.

6. A recirculating pump according to claim 3 wherein said sensors detect a first chamber near empty condition and in response said electronic control drives said air conduit into its second state and drives said transfer conduit into its second state; and said sensors detect a second chamber near empty condition and in response said electronic control drives said air conduit into its first state and drives said transfer conduit into its first state.

7. A pump according to claim 2 wherein said inlets are located at an upper portion of said first and second chambers and said outlets are located respectively at relatively lower portions of said first and second chambers.

8. A pump according to claim 2 wherein said air conduit in said first state couples said second chamber inlet to said atmospheric pressure and in said second state couples said first chamber inlet to said atmospheric pressure.

9. A pump according to claim 2 wherein said pump alternates between establishing concurrently said first state for said air conduit and for said transfer conduit network followed by establishing concurrently said second state for said air conduit and for said transfer conduit.

10. An electronic shuttle controlled pumping system in combination with a set of pump units, the pump units each including a mechanical seal, a first actuator shifting said pumping system toward a first condition, and a second actuator shifting said pumping system toward a second condition, each of said first and second actuators being actuated electronically, said pump conveying a mechanical seal flushing media by alternate electronic actuation of said first and second actuators to drive said pumping system alternately into said first and second conditions, said combined electronic shuttle controlled pumping system and set of pump units comprising:

a first signal input receiving a first signal representing said first condition of said pumping system;

a second signal input receiving a second signal representing said second condition of said pumping system;

an actuator driver dictating actuation of said first and second actuators, said actuator driver electronically actuating said first actuator upon detecting said second condition and until detecting said first condition, said actuator driver electronically actuating said second actuator upon detecting said first condition and until detecting said second condition;

an air source for coupling to air pressurized relative to ambient air pressure;

a first chamber including an inlet and an outlet;

a second chamber including an inlet and an outlet;

an air pressure conduit network coupling in a first state thereof said air source and said first chamber inlet and coupling in a second state thereof said air source and said second chamber inlet and;

and a transfer conduit network communicating said media with a respective mechanical seal of said pump units, in a first state thereof said first chamber outlet and said second chamber inlet and communicating said media with said mechanical seals, in a second state thereof said second chamber outlet and said first chamber inlet, said first actuator shifting said air pressure conduit network into said first state thereof and shifting said transfer conduit network into said first state thereof, said second actuator shifting said air pressure conduit network into said second state thereof and shifting said transfer conduit network into said second state thereof.

11. A combined electronic shuttle controlled pump system and the set of pump units according to claim 10 wherein said mechanical seals are double mechanical seals.

* * * * *